US005927799A

United States Patent [19]

Tornero

[11] Patent Number: 5,927,799

[45] Date of Patent: Jul. 27, 1999

[54] STOWABLE TRAY AND METHOD

[75] Inventor: Marta V. Tornero, Greensboro, N.C.

[73] Assignee: Carson's Inc., High Point, N.C.

[21] Appl. No.: 09/088,521

[22] Filed: Jun. 1, 1998

[51] Int. Cl.[6] ..... A47B 39/00; A47B 83/02

[52] U.S. Cl. ..... 297/145; 297/160; 297/162; 297/170; 297/171; 297/173

[58] Field of Search ..... 297/145, 144, 297/160, 162, 170, 171, 173, 174; 108/77, 78

[56] References Cited

U.S. PATENT DOCUMENTS

| | | | |
|---|---|---|---|
| D. 260,058 | 8/1981 | Ponzellini | D6/41 |
| 1,217,231 | 2/1917 | Soper | 297/145 |
| 1,771,231 | 7/1930 | Parkinson | 297/145 |
| 1,869,444 | 8/1932 | Tobey | 297/145 |
| 2,330,627 | 9/1943 | Reynolds | 297/145 |
| 2,741,300 | 4/1956 | Tubbs et al. | 297/145 |
| 2,845,113 | 7/1958 | Keel | 297/145 |
| 3,467,432 | 9/1969 | Sullivan | 297/162 |
| 3,583,760 | 6/1971 | McGregor | 297/145 |
| 3,632,161 | 1/1972 | Arfaras | 297/145 |
| 4,372,604 | 2/1983 | Raksanyi et al. | 297/145 X |
| 4,834,449 | 5/1989 | Engelman | 297/145 |
| 4,852,940 | 8/1989 | Kanigowski | 297/145 |
| 4,944,552 | 7/1990 | Harris | 297/145 |
| 5,050,929 | 9/1991 | Gueringer et al. | 297/145 |
| 5,630,642 | 5/1997 | Grimmett et al. | 297/145 |

FOREIGN PATENT DOCUMENTS

| | | | |
|---|---|---|---|
| 521240 | 7/1953 | Belgium | 297/145 |
| 667894 | 3/1952 | United Kingdom | 297/145 |
| 1600744 | 10/1981 | United Kingdom | 297/145 |

*Primary Examiner*—Peter M. Cuomo
*Assistant Examiner*—Rodney B. White

[57] ABSTRACT

A chair comprises a stowable tray in which the tray is shaped like a rhomboid and folds across the seat of the chair at an angle with respect to the chair back. A spring provides assistance when the stowable tray is drawn from its housing. Additionally, a number of noise mufflers are provided, which make the chair well suited for use in settings where silence is valued.

17 Claims, 6 Drawing Sheets

STOWABLE TRAY AND METHOD

BACKGROUND OF THE INVENTION

1. Field of the Invention

This invention pertains to a tray that is selectively stowable in a chair arm.

2. Description of the Prior Art and Objectives of the Invention

In auditorium, classroom and office settings, people frequently require a writing surface, but conventional desks are too large to make efficient use of the space available. A number of space saving stowable trays exist such as those disclosed in U.S. Pat. Nos. Des. 260,058; 4,944,552; 5,050,929; and 5,630,642. While useful in solving space problems, and accomplishing the intended goals of their inventors, these devices tend to be noisy when the user either pulls the tray into an open position or stows the tray after use.

Additionally, these prior trays tend to be parallel to and fairly close to the back of the chair. This is suitable for svelte users, but it can cause discomfort in larger users who require additional room between the tray and the back of the chair.

Furthermore, prior trays generally require an arcuate, swinging motion for proper positioning, although Gueringer et al. does disclose a tray which is pulled vertically upwardly before folding over the seat of the chair. This arcuate motion requires more space between chairs to avoid accidentally contacting a nearby chair, and the vertical motion requires a degree of strength and manual dexterity that some individuals may not possess.

Thus, with the above concerns in mind, it is an objective of the present invention to provide a stowable tray which includes sound muffling devices used as the tray is moved from a stowed position or an open position.

It is a further objective of the present invention to provide a tray which is angled from the back of the chair in order to accommodate both large and small individuals.

It is still a further objective of the present invention to provide a tray which incorporates a spring mechanism to help lift the tray in a vertical manner.

It is yet a further objective of the present invention to provide a tray housing which is self-contained and easily installed on a chair.

It is another objective to provide a method of using the stowable tray of the present invention.

It is still another objective to provide a chair arm which has an angled, contemporary appearance.

Still other objectives and advantages will become readily apparent to those skilled in the art upon further reference to the following detailed description and attached drawing figures.

SUMMARY OF THE INVENTION

A conventional chair is modified by replacing the conventional arm and arm rest with the improvement of the present invention. The improved arm comprises a housing shaped like a rhomboid. I.e., the top and bottom surfaces are parallel, preferably to the floor, or other planar surface on which the chair rests, and the front and back edges are non-perpendicular to the floor. An arm rest overlies and is attached to the upper surface of the rhomboid. Inside the housing, a two portion tray is positioned. The first portion is hingedly, tandemly affixed to the second portion, and both ride within a pair of oppositely positioned rails. The first portion includes a stop plate which strikes the upper interior surface of the housing to prevent the tray from being completely withdrawn. The stop plate is muffled by a resilient bumper attached thereto. This resilient bumper is preferably a section of polyethylene tubing which prevents the hard, rigid surfaces of the upper inner housing surface and the stop plate from making direct contact, thereby muffling any potential noise.

Additionally, a loop ply, such as sold under the trademark VELCRO, is used in the rails to prevent undue noise. These muffling features are especially desirable in conference rooms or the like where noise is undesirable.

Within the rhomboid-shaped housing, a rhomboidal, generally planar second portion folds to form the tray. Being slanted, the second tray portion is non-parallel to the back of the chair thereby allowing additional space between the back of the chair and the tray to accommodate differently sized users.

In the preferred embodiment, there is a windable steel coil which is affixed to the housing and to the first portion of the stowable tray. As the tray is drawn upwardly out of the housing, the steel coil winds to help lift the tray. In this manner, people of very limited strength can lift the tray for use.

The preferred method of using the stowable tray comprises sitting in a chair, grasping the arm rest of the stowable tray and drawing or pulling the tray up vertically, while the sounds emitted are muffled. When the tray stop plate engages the inner surface of the housing, the second portion of the tray is then folded downwardly, horizontally over the lap of the user. The horizontal slant of the tray provides ample room even for large users who might be uncomfortable or constricted by conventional stowable trays.

DETAILED DESCRIPTION OF THE PREFERRED EMBODIMENTS AND OPERATION OF THE INVENTION

Figure 1:
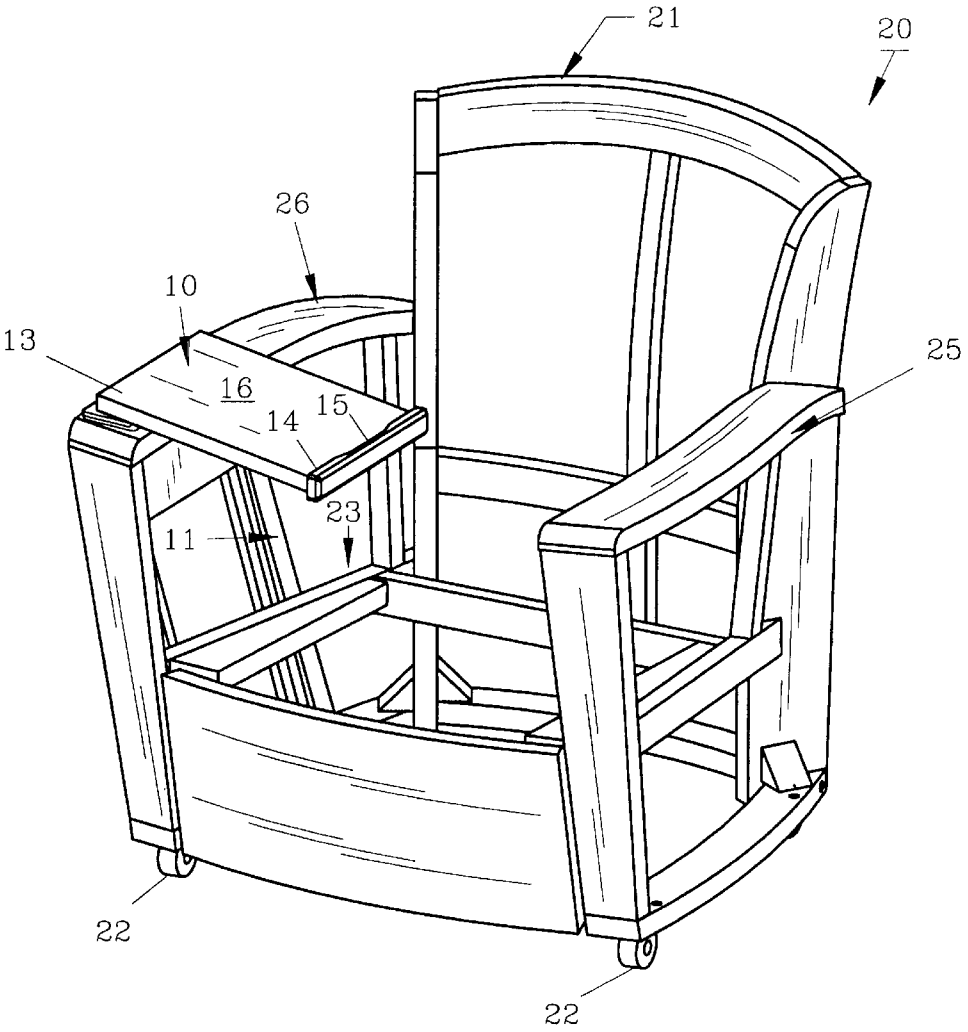
FIG. 1 shows a front perspective view of a chair frame without upholstery having the stowable tray of the present invention attached.
Figure 2:
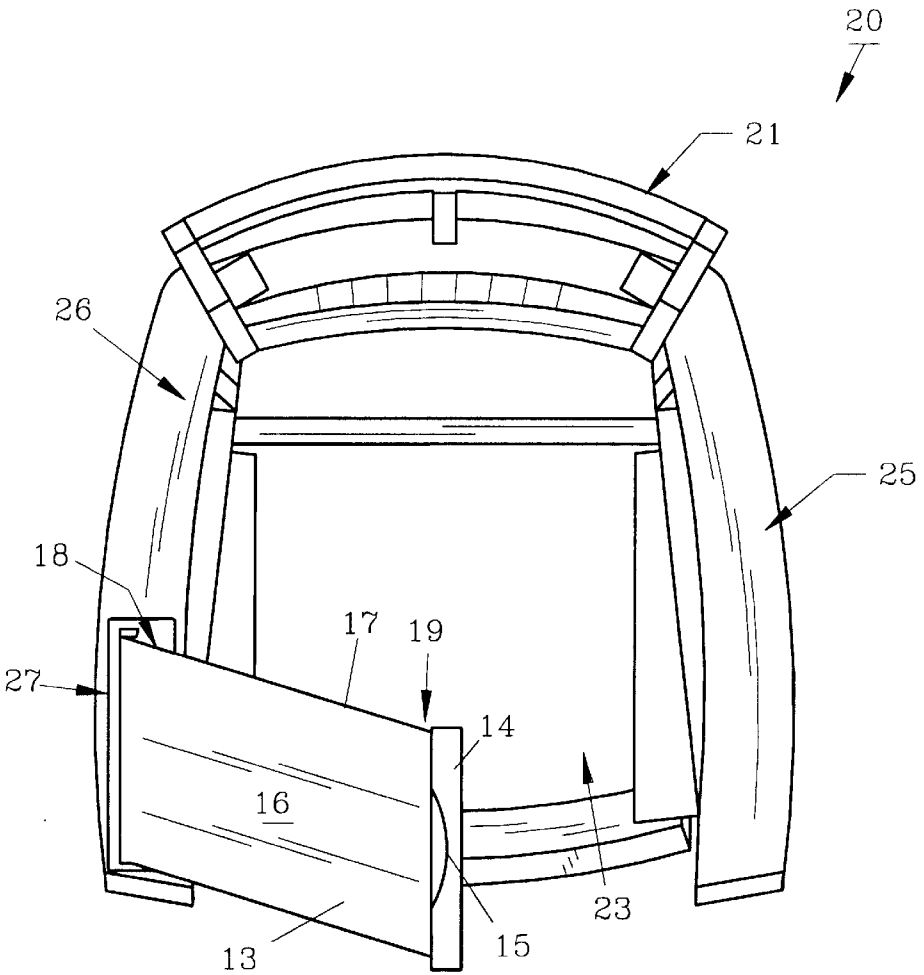
FIG. 2 illustrates a top view of the chair frame of FIG. 1.

Turning now to the drawings, specifically FIGS. 1 and 2 show preferred stowable tray 10 mounted on chair frame 20. Chair frame 20 is a typical chair frame, with back 21, casters 22, and seat area 23. As shown, chair frame 20 is skeletal, and it should be understood that, upholstered cushions (not shown) would be conventionally placed thereon to provide support and comfort after usual upholstery and exposed wood finishing. Chair frame 20 also includes conventional chair arm 25, and arm assembly 26 which has been modified to include housing 11 of stowable tray 10. Stowable tray 10 comprises first portion 12 (FIGS. 3–6) and second portion 13. Both are preferably planar and made from wood, although other materials are acceptable including metal or plastic depending on appearance and other desires. Second portion 13 includes arm rest 14 which defines handle 15 on both sides of second portion 13. As seen in FIGS. 1 and 2, second portion 13 provides smooth writing surface 16 positioned above seat area 23 of chair frame 20. As tray 10 is preferably rhomboidal shaped, second portion 13 is also rhomboidal, and interior edge 17 (FIG. 2) slants forwardly away from back 21. Thus the distance between proximal end 18 of second portion 13 and back 24 is less than the distance between distal end 19 of second portion 13 and back 24. Arm rest 14 fits within arm recess 27 (FIG. 2) while leaving handle 15 exposed so that user may easily grasp handle 15 while tray 10 is in its stowed position (FIG. 4).

Figure 3:
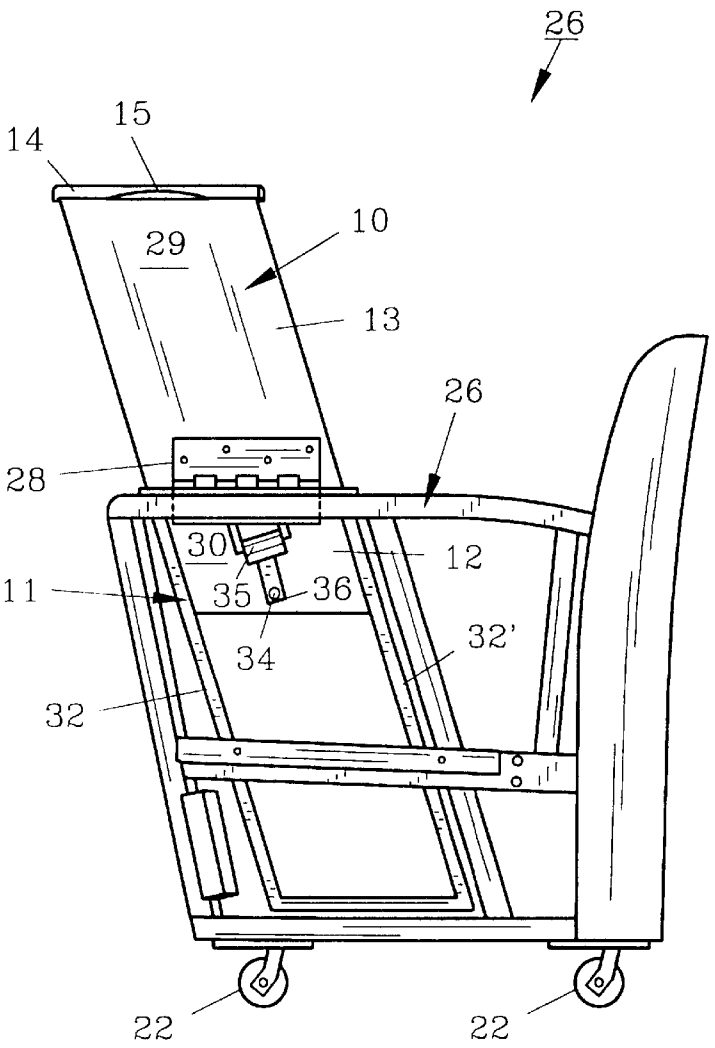
FIG. 3 demonstrates a right side view of the arm assembly of the chair frame of FIG. 1 with the stowable tray in its extended position.
Figure 4:
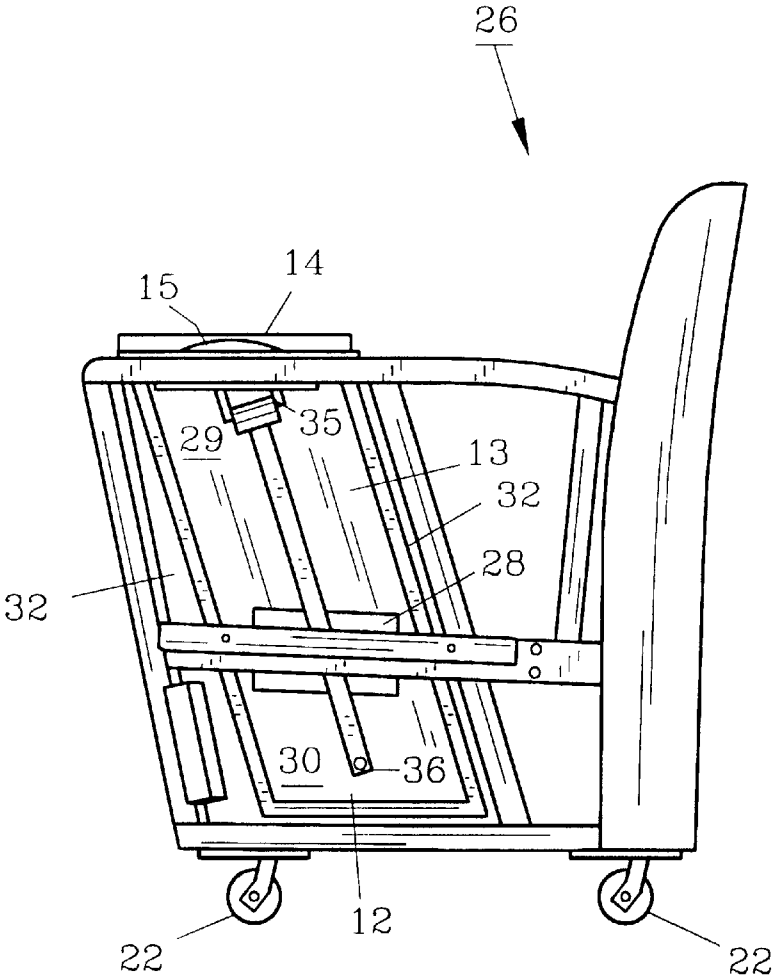
FIG. 4 depicts the arm assembly of FIG. 3, but with the tray in its stowed position.

FIGS. 3 and 4 illustrate the extended and stowed positions of stowable tray 10 respectively. First portion 12 of tray 10 is also a rhomboid, and it fits within rhomboid housing 11. First portion 12 is connected to second portion 13 by hinge 28. Hinge 28 is attached to inner surfaces 29 and 30 of first and second portions 12 and 13 respectively. In all three positions, stowed, extended or open, first portion 12 remains within housing 11 and below upper surface 31 of housing 11. Also visible in FIGS. 3 and 4 is windable steel coil 35 whose proximal end is mounted on housing 11 (see also FIG. 5) and whose distal end 36 is attached to first portion 12 by fastener 34. When stowable tray 10 is in the stowed position, steel coil 35 is unwound and extends the substantial length of tray 10 (FIG. 4), but in the extended and open positions of tray 10 (FIGS. 1 and 3) steel coil 35 is wound tightly.

Figure 5:
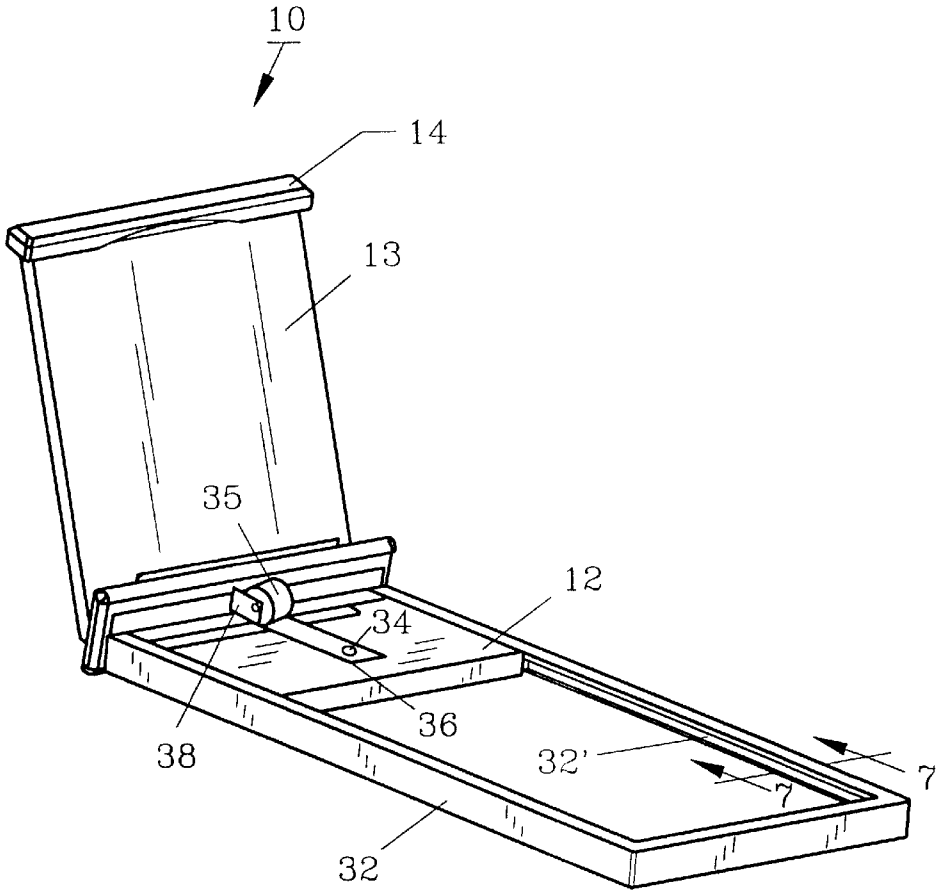
FIG. 5 features the stowable tray and the housing removed from the arm assembly.

Steel coil 35, in FIG. 5, is preferably an elongate strip of thin, flexible steel wound on a spring loaded cylinder. The cylinder is mounted on plates 38 (only one shown) and contains a coiled spring (not shown). As the elongate strip is unwound during stowing, tension is placed on the coiled spring. When the elongate strip is wound as in raising tray 10, tension is released from the coiled spring. The elongate strip may have some resilient properties which help facilitate the lifting of tray 10. While a steel coil is preferred, other resilient members could also be used within the scope of the present invention. Acceptable substitutes include a nylon cord or other elastomers.

Figure 7:
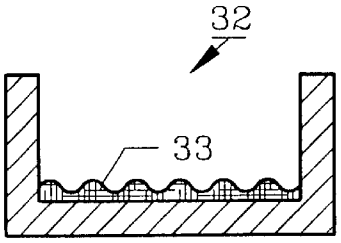
FIG. 7 shows an enlarged cross-sectional view along lines 7—7 of FIG. 5 of one of the rails used to guide the stowable tray of the present invention.

First and second portions 12 and 13 ride within housing 11 on conventional rails 32, 32' which may be metal or other rigid materials. A cross-section of rail 32' is seen in FIG. 7. Rails 32, 32' are generally u-shaped and contain a strip of loop ply 33 within, such as the loop ply sold under the trademark VELCRO. Loop ply 33 muffles the sound of first section 12 and second section 13 moving within rails 32, 32'.

Figure 6:
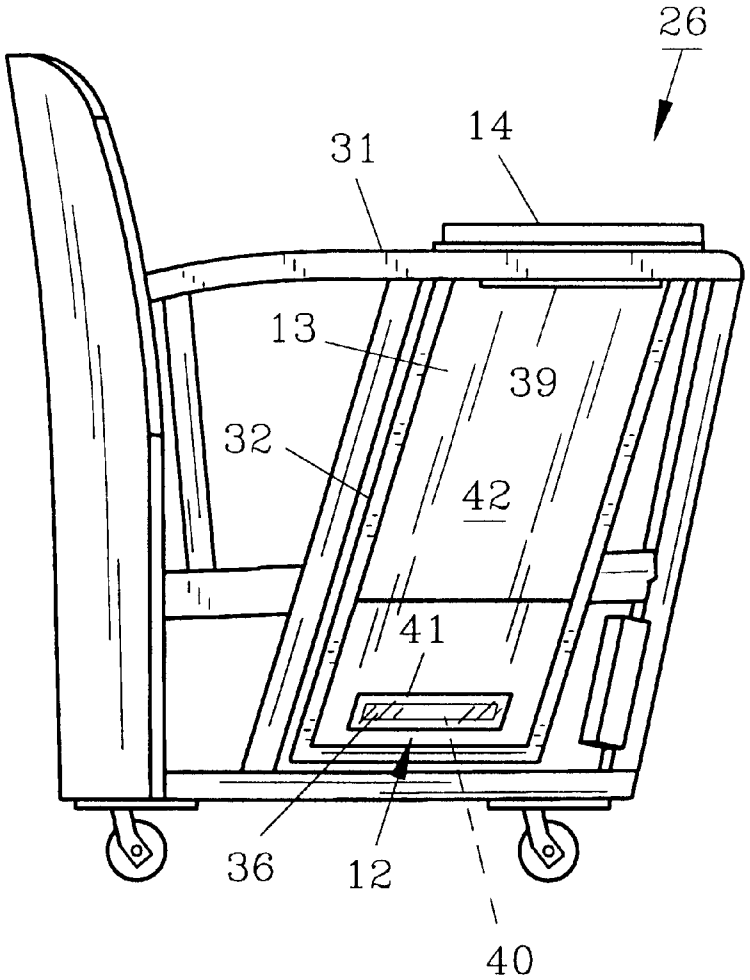
FIG. 6 pictures a left side view of the arm assembly of FIG. 3.

FIG. 6 shows another means to muffle sound in chair frame 20 when stowable tray 10 is raised and lowered. Specifically, on exterior surface 42 of first portion 12, stop plate 40 is positioned. Stop plate 40 is enclosed within resilient bumper 41, which is preferably a resilient polymeric material such as a piece of slit polyethylene tubing, although a resilient foam or the like could be used. Resilient bumper 41 prevents metal to metal contact between stop plate 40 and upper inner surface 39 of housing 11 when tray 10 is raised into the extended position, thereby muffling noise.

The preferred method of using stowable tray 10 comprises the user (not shown) sitting in the chair built upon frame 20 on seat area 23. The user then grasps handle 15 and lifts vertically upwardly, drawing or pulling second section 13 upwardly. Stop plate 40 will contact upper inner surface 39, thereby halting the upward movement of tray 10. Steel coil 35 will simultaneously wind, thereby providing additional force to move tray 10 into the extended position seen in FIG. 3. This facilitates lifting tray 10 by those with impaired strength. As stop plate 40 arrests the upward motion, resilient bumper 41 muffles the sound emitted by the contact between stop plate 40 and upper inner surface 39. Likewise, loop ply 33 muffles the sound created as tray 10 slides within rails 32, 32'.

Once in the extended position (FIG. 3) the user then folds second portion 13 into its open position (FIG. 1), downwardly across seat area 23, but with distal end 19 slanted away from the user, thereby allowing more room between back 21 and second portion 13. The user may then write on or otherwise use horizontal writing surface 16. Once the need for writing surface 16 has passed, the user lifts second portion 13 back into its extended position (FIG. 3) and slides tray 10 back into housing 11. Steel coil 35 acts as a brake against the downward movement of tray 10 helping muffle sounds together with loop ply 33.

The preceding recitation is provided as an example of the preferred embodiments and is not meant to limit the nature of scope of the present invention or appended claims.

I claim:

1. In a chair having a seat and an arm assembly with a stowable tray in the arm assembly, the improvement comprising: a foldable tray, said tray comprising:

a) a first portion, said first portion positioned within said arm assembly;

b) a second portion, said second portion hingedly affixed to said first portion, said second portion movable between a stowed position and an open position;

c) a coil, said coil attached to said first portion, whereby said coils aids the movement of said second portion between said stowed position and said open position; and d) a pair of rails, said first and said second portions slidably positioned on said pair of rails.

2. The chair of claim 1 wherein said coil comprises an elongate member having a distal end, said distal end attached to said first portion.

3. The chair of claim 1 further comprising a stop plate, said stop plate mounted on said first portion.

4. The chair of claim 3 wherein said stop plate further comprises a resilient bumper.

5. The chair of claim 1 wherein said second portion is angularly disposed relative to said back rest when in said open position.

6. The chair of claim 1 further comprising means to muffle sound emitted by said chair as said stowable tray is moved, said muffling means positioned in said arm assembly.

7. A stowable tray comprising:

a) a housing, said housing having a rhomboid shape;

b) a first tray portion, said first tray portion positioned in said housing; and c) a second tray portion, said second tray portion hingedly affixed to said first tray portion, said second tray portion movable between a stowed position and an open position;

whereby said housing is positioned within a chair arm assembly and said second tray portion is positioned within said housing when in said stowed position, and said second tray portion is angled across the chair when in said open position.

8. The tray of claim 7 further comprising a coil, said coil mounted in said housing.

9. The tray of claim 7 wherein said second tray portion is planar.

10. The tray of claim 7 wherein said second tray portion further comprises an arm rest.

11. The tray of claim 7 wherein said second tray portion is made from wood.

12. The tray of claim 7 further comprising a stop plate, said stop plate positioned on said first tray portion.

13. The tray of claim 12 wherein said stop plate further comprises a resilient bumper.

14. The tray of claim 7 further comprising means to muffle sound created when moving said second tray portion between said open position and said stowed position.

15. A method of utilizing a tray, said method comprising the steps of:

a) affixing a rhomboidal-shaped housing containing a tray to a chair;

b) urging the tray from said housing; and c) folding the tray horizontally across the chair angularly thereto.

16. The method of claim 15 further comprising the step of muffling sound created by the tray as it moves.

17. The method of claim 16 wherein muffling sound comprises placing a resilient bumper of a stop plate.

* * * * *